United States Patent [19]

Fanberg

[11] Patent Number: 4,683,783

[45] Date of Patent: Aug. 4, 1987

[54] CAR DOOR OPENING TOOL AND METHOD

[76] Inventor: Victor V. Fanberg, 5221 Mt. Ariane Ter., San Diego, Calif. 92111

[21] Appl. No.: 872,540

[22] Filed: Jun. 10, 1986

Related U.S. Application Data

[63] Continuation of Ser. No. 767,899, Aug. 21, 1985, abandoned, which is a continuation of Ser. No. 735,587, May 20, 1985, abandoned, which is a continuation of Ser. No. 520,485, Aug. 4, 1983, abandoned.

[51] Int. Cl.[4] ..... E05B 19/20; B25B 33/00

[52] U.S. Cl. ..... 81/15.9

[58] Field of Search ..... 81/15.9, 488, 3.44; 29/278; 254/131; 294/19.1, 26; 70/465

[56] References Cited

U.S. PATENT DOCUMENTS

| | | | |
|---|---|---|---|
| 1,994,532 | 3/1935 | Ratzlaff | 81/3.44 |
| 2,907,237 | 10/1959 | Casas | 81/15.9 |
| 3,537,685 | 11/1970 | Gregory | 254/131 |
| 3,664,211 | 5/1972 | McConnell | 81/15.9 |
| 3,819,221 | 6/1974 | O'Connor | 81/15.9 |

OTHER PUBLICATIONS

All-Lock Service Institute Automotive Lock Service Manual, ©1981, pp. 188-192 and 315-325.

*Primary Examiner*—Frederick R. Schmidt
*Assistant Examiner*—Debra S. Meislin
*Attorney, Agent, or Firm*—Brown, Martin, Haller & Meador

[57] ABSTRACT

A car door opening tool for opening a car door of the type having a locking bar located within that functions to open the car door in response to the application of an unlatching force thereto. A shaft of sufficient length to access the locking bar through the car door's window slot from a position outside of the car door is provided with coupling device at its gripping end for both engaging the locking bar and for gripping it in response to a force-couple applied to the handle end of the shaft. By inserting the gripping end of the shaft through the window slot to engage the locking bar and then applying a force-couple to the handle end while simultaneously impressing the unlatching force to the shaft, the car door is caused to open.

15 Claims, 4 Drawing Figures

CAR DOOR OPENING TOOL AND METHOD

This is a continuation of application Ser. No. 767,899 filed Aug. 21, 1985 which was a Continuation of Appln. Ser. No. 735,587 filed May 20, 1985 which was a Continuation of Appln Ser. No. 520,485 filed Aug. 4, 1983, all abandoned.

BACKGROUND OF THE INVENTION

This invention relates in general to car door opening tools, and more particularly to tools which are used to open a car door of the type having an otherwise generally inaccessible locking bar located within it which functions to open the door in response to the application of an unlocking force.

DISCUSSION OF THE PRIOR ART

It is well known that persons who have locked themselves out of their car in a remote or dangerous location, at a later hour, in inclement weather, or at a time when they are late for an engagement, experience the fears and frustations involved, and the need for a tool for opening the locked car door.

A spare set of keys is often unavailable, a capable locksmith is often difficult to locate, and the car door opening tools employed by tow-truck operators and policemen are often ineffective. A person is often left with the option of breaking one of the car windows to gain access.

Existing tools for opening a car door employ various configurations for use in opening various types of car doors. Some are of the "coat-hanger" type. They are made from a flexible wire bent into a form enabling the user to access the car door locking button from a position outside of the car door by inserting the tool through the weather stripping around the car door or car door window.

Other tools are formed so that the user can insert the tool through a car door window slot into the interior of the car door to engage and pull the car door locking bar contained therein.

Still other tools are designed to be inserted through some other opening in the car door such as the latch opening in order to fish for and engage the locking bar in an attempt to pull it sufficiently to unlock the door.

Existing tools for opening car doors are often difficult to use because they require "fishing" for the locking bar. The operator must often have a good knowledge of the interior of the car door and the position of the locking bar, and he must often patiently move the unlocking tool about in the interior of the car door in a haphazard attempt to engage the locking bar.

Existing car door opening tools often have no adequate means of engaging the locking bar so that longitudinal motion can be conveniently imparted thereto. After locating and engaging the locking bar, the tool can slide along the length of the locking bar without imparting sufficient motion thereto to unlock the car door. Such existing tools can grip the locking bar only at a point where the locking bar has a bend in it.

Large forces must be impressed at one end of some existing tools to cause them to grip the locking bar so that sufficient longitudinal motion will be imparted to it to unlock the car door. Such tools are often difficult to grasp or pull to impart sufficient longitudinal motion to the locking bar.

Additionally, existing tools for opening car door are often adapted for use with only the right hand or left hand door, a separate tool being required for each side of the car.

Therefore, it is desirable to have a car door opening tool with which a person can quickly and easily locate and grip the locking bar in order to pull it sufficiently to open the car door. It is desirable to be able to grip the locking bar at a point on the locking bar that has no bend. It is further desirable to have a car door opening tool that can open both the left-hand and right-hand doors of a car.

SUMMARY OF THE INVENTION

In an exemplary embodiment, the invention provides a car door opening tool intended for use with a car door having a locking bar located within that functions to open the door in response to the application of an unlatching force. The tool employs a shaft which can be inserted along side the car door window into the interior of the car door to engage the locking bar. Coupling means connected to the end of the shaft act to grip the engaged locking bar when the shaft is axially twisted and to couple the unlatching force from the shaft to the locking bar, so that by simultaneously axially twisting the shaft while impressing the unlatching force to the shaft causes the car door to open.

The car door opening tool may employ a string attached to it near the locking bar so that the unlatching force can be applied to the car door by gripping the locking bar with the tool and pulling on the string from a position outside of the car door.

The invention therefore provides a new and improved tool which may be used to open therefore difficult to open locked doors. It can grip a locking bar at a straight section thereof as opposed to being able to grip the bar only where a bend exists. With a string attached to the tool, it can be used to couple an unlatching force to a difficult-to-access locking bar with the string bending around any corners or obstacles that may lie between the locking bar and an operator of the tool. Thus, the invention is a useful addition to the tools carried by policemen, tow-truck operators, and locksmiths, and a convenience to any person that may be called upon to assist in opening a car door.

The objects, features and advantages of this invention will be readily understood when the detailed description thereof is read in conjunction with the accompanying drawing therein:

DETAILED DESCRIPTION OF THE INVENTION

Figure 1:
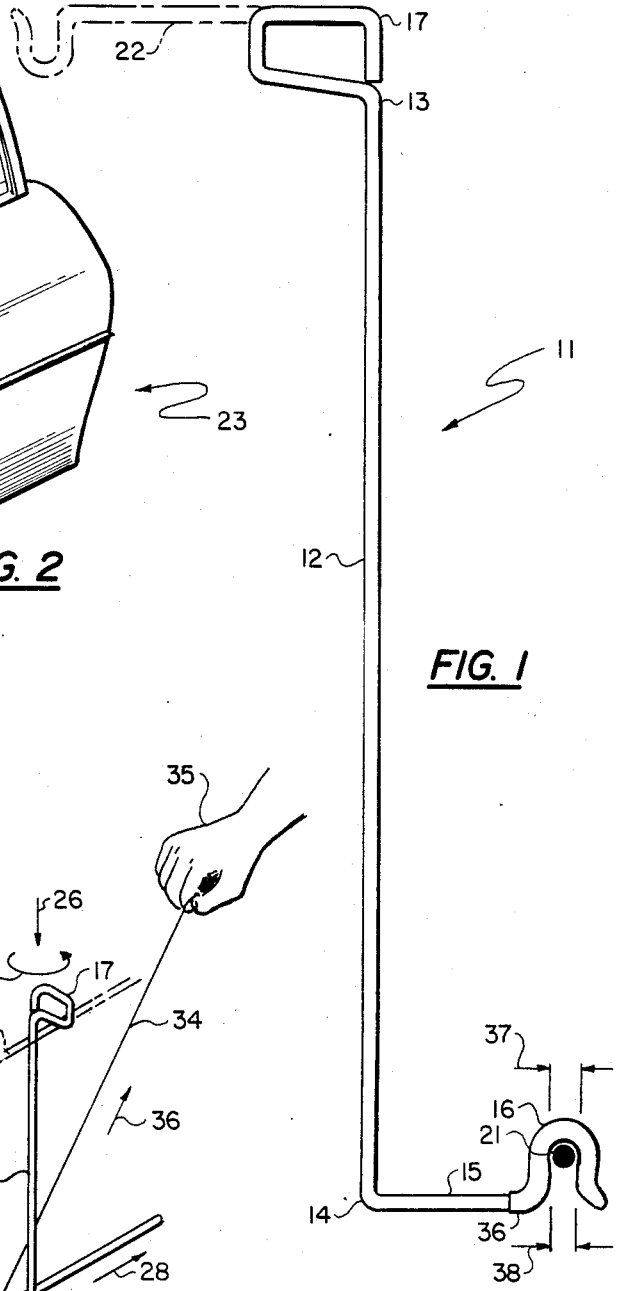
FIG. 1 is an elevation view of the car door opening tool, with an alternate embodiment in phantom lines.

With reference to the drawing, the details of the car door opening tool constructed in accordance with the principles of this invention are shown. The tool is referred to generally by reference number 11, and by reference to FIG. 1 it can be seen to comprise basically a an elongate, substantially straight shaft 12 having a handle end 13 with a handle 17 and a gripping end 14 with coupling means formed by an offset member 15 and a coupling or locking bar engaging device 16. FIG. 1 illustrates the coupling device 16 engaging a locking bar 21. Also illustrated in phantom lines in FIG. 1 is an alternate embodiment 22.

The car door opening tool illustrated is of single piece construction, preferably made from a length of wire-like material such as circular bar stock formed to the desired configuration. Other materials and methods of fabrication may be used as long as the tool is sufficiently strong to withstand the forces required to grip and move the locking bar, and sufficiently rigid not to deform during such use. As can be seen, a handle is formed at handle end 13 of the shaft 12 by a few simple bends in the wire. An alternate embodiment 22 may be formed at the handle end to serve both as a handle and as an alternately-dimensioned offset member with another coupling device formed therein. An approximately five inch long offset member has been found advantageous as an alternate. The handle serves as a means to grasp the shaft with one's hand and to facilitate axially twisting the shaft as well as facilitating the application of an axially-directed engaging force and an unlatching force to the shaft. The handle also serves to prevent the shaft from sliding entirely within the car door interior, as well as providing a convenient means of holding the tool as it is being positioned through the car door window slot or otherwise.

Shaft 12 is made form steel wire-like material such as circular bar stock of approximately one-eighth stock diameter. It is particularly advantageous in the practice of the invention to use 17-4PH heat treated stainless steel, which has been found withstands the bending forces involved without deforming, although other sizes and materials may suffice to withstand the forces involved. Generally available spring steels may be used to withstand the bending forces involved. The wire is of generally circular cross section, although other cross sections may be used as long as they do not substantially impair the ability to twist the shaft after it has been inserted through the car door window slot, it being desired to twist the shaft so that the offset member can be positioned parallel to the car door window in order to insert it through the car doow window slot and then positioned to engage the car door locking bar 21 by twisting the shaft approximately one-quarter turn. The distance between handle end 13 and gripping end 14 is approximately fifteen inches, although the length of the shaft may be varied so long as it is sufficient to allow engaging the locking bar with the coupling device with the shaft extending through the car door window slot to a position outside of the car door. The shaft is straight between its handle and gripping ends.

Offset member 15 is formed by bending the wire-like material used to form shaft 12 so that a substantially right angle is formed. The length of offset member 15 is approximately two inches, although other lengths may be employed so long as the offset member is not too long to allow inserting the gripping end 14 and coupling device 16 through the car door window slot 25, nor tool ong to permit positioning offset member 15 and coupling device 16 in the car door interior 31 between the interior surface of inside door panel 32 and the interior surface of outside door panel 33.

Coupling device 16 is formed from the length of wirelike material into a hook-type configuration, although other materials and methods of fabrication can be employed without avoiding the inventive concept therein embodied. The hook-type configuration has a hook opening which is dimensioned to enable the hook-type configuratin to fit partially around the locking bar 21 so that it can hook onto and engage the locking bar with the hook opening facing generally away from handle 17 in a direction substantially parallel to the longitudinal axis of shaft 12. As can be seen with reference to FIG. 4, the hooktype configuration of coupling device 16 may open in any other direction so long as the axially-directed engaging force illustrated by arrow 26 is applied in the same direction and the moment illustrated by arrow 27 is applied so as to cause the hook-type configuration to grip the locking bar.

Referring again to FIG. 1, it is seen that the hook-type configuration of coupling device 16 has a hook opening illustrated by dimension 37 which is approximately one-fourth inch across, although other size openings can be employed as long as they easily fit around locking bar 21 sufficiently to engage and grip it. It is also seen that the mouth of the hook opening is approximately three-sixteenths inch across as illustrated by dimension 38 to allow the coupling device to be snapped onto locking bar 21 and retained there while the car door is opened, although the car door opening tool has been found to function effectively with the mouth of the hook opening equal to or greater than the hook opening itself.

Figure 4:
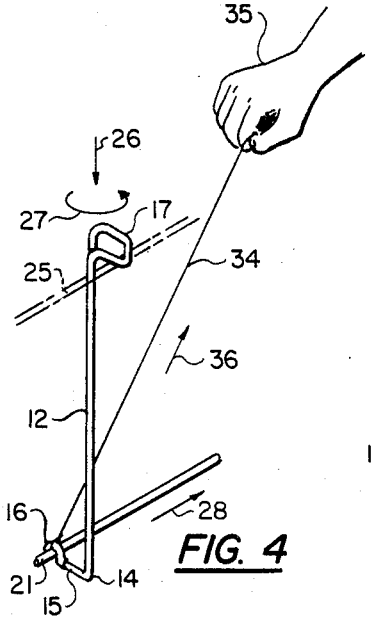
FIG. 4 is an alternate embodiment of the car door opening tool with a string attached.

With reference to FIG. 1, it can be seen that the hook-type configuration of coupling device 16 is formed so that the hook opening cross sectional area generally conforms to the cross sectional area of a circular locking bar, although it may be otherwise formed as long as engagement of the locking bar is not significantly inhibited and the force-couple applied to the shaft causes coupling device 16 to grip locking bar 21 sufficiently to couple the unlatching force, illustrated in FIG. 4 by arrow 28, from the shaft 12 to locking bar 21 to move the locking bar and open the car door.

With reference to FIG. 1 it may be readily understood that the coupling device may grip the locking bar by making contact with the locking bar, in response to axially-twisting the shaft, at two locations on the locking bar that are positioned generally diametrically opposite one another about the circumference of the bar. By axially-twisting the shaft sufficiently, a force-couple is generated at those locations of contact with sufficient resulting frictional forces to couple the unlatching force from the shaft to the locking bar.

To further facilitate sufficiently gripping locking bar 21, coupling device 16 may be provided with a friction enhancing coating 36 by commonly employed means such as dipping it in plastic or rubber. A suitable coating has been found to be H.C.F. Hard Coat Finish manufactured by P.D.I., Inc. of St. Paul, Minn., and the rubber or plastic coatings commonly applied to the handles of hand tools such as pliers may be used.

Figure 2:
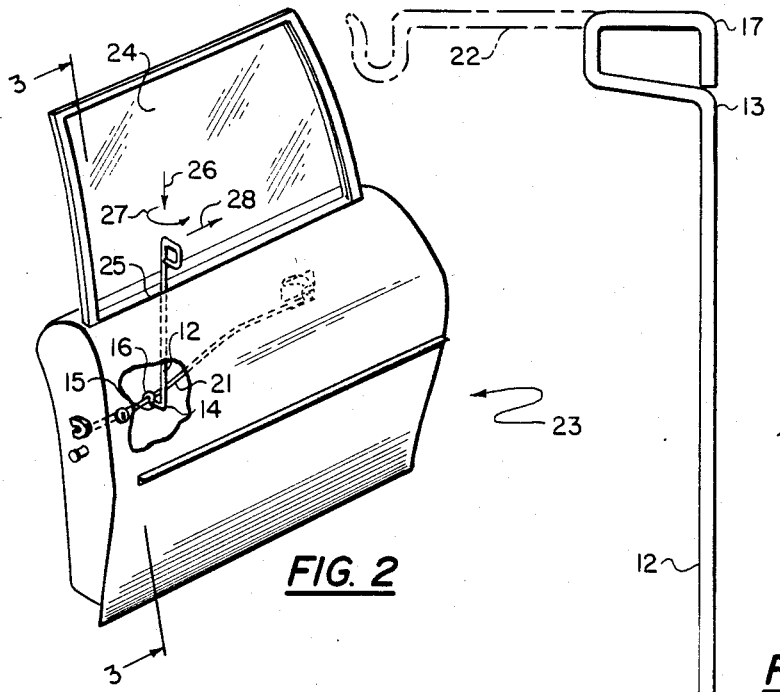
FIG. 2 is a perspective view with a broken out section showing the car door opening tool engaging a locking bar.

FIG. 2 illustrates the car door opening tool 11 in position to open a car door 23 having a window 24 and an associated car door window slot 25 which defines an access way to the locking bar from a position outside of the car door thorugh which the car door unlocking tool can be inserted. The car door opening tool extends from a position outside of the car door through the car door window slot 25 to engage the locking bar 21. As further illustrated in FIG. 2, a car door opening tool may be used to open a car door by first engaging the locking bar, and then applying an axially-directed engaging force to the handle 17 as illustrated by arrows 26. A twisting moment may then be applied to the handle as illustrated by arrow 27, while simultaneously applying a force to the handle in a direction 28A substantially parallel to the unlatching direction 28 of the locking bar 21 door opening tool in the manner illustrated in FIG. 2 will cause the unlatching force to be coupled by means of coupling device 16 to the locking bar 21, causing the locking bar to move and the car door to open.

Figure 3:
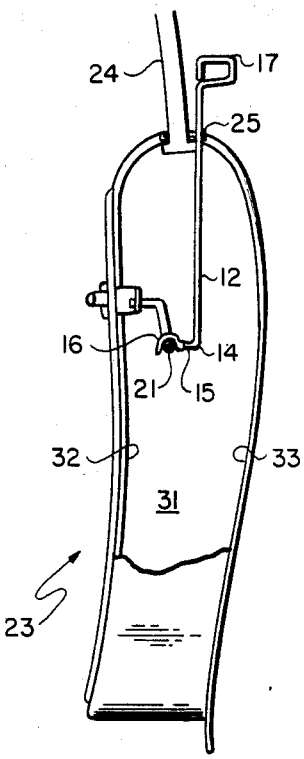
FIG. 3 is a sectional view of a car door taken along line 3—3 of FIG. 2 with the tool engaging the locking bar in position through the car door window slot.

Positioning of the car door opening tool is further illustrated in FIG. 3 wherein the shaft 12 is shown inserted through the car door window slot 25 to a position where the coupling device 16 engages locking bar 21. As can be readily understood with reference to FIG. 3, offset member 15 offsets coupling device 16 from shaft 12 in order to facilitate engagement of locking bar 21. Offset member 15 also acts as a moment arm which facilitates gripping locking bar 21 with coupling device 16. Offset member 15 may be dimensioned to fit easily inside car door interior 31 defined by the interior surface of the inside door panel 32 and the interior surface of the outside door panel 33.

As illustrated in FIG. 4, the car door opening tool may be fitted with a string-like member 34, one end of which may be attached to coupling device 16 or to offset member 15, with the other end extending through car door window slot 25 to a position outside of the car door and pulled upon as depicted in FIG. 4 by arrow 36 is such as to impart the unlatching force 28 to the unlocking bar 21 to cause it to move and open the car door. The string-like member maybe a flexible wire, cord, string, or the like capable of bending around corners and obstacles which may lie between the locking bar and the position of the human hand 35. The string-like member employs a material of sufficient strength to withstand the required string force 36, and it also serves to reduce the strength requirements of the wire-like material used for the tool since less force is required to be exerted at the handle end.

Reference to FIG. 4 illustrates the forces involved which function to grip the locking bar 21 sufficiently to couple the unlatching force illustrated by arrow 28 thereto. Axially twisting the shaft at the handle 17 results in the moment illustrated in FIG. 4 by arrow 27. The moment results in forces which may be visualized as a force-couple acting at two locations of contact between coupling device 16 and locking bar 21 on generally diametrically opposite sides of the locking bar. The force-couple acts to force the coupling device 16 against locking bar 21 at the two points of contact, with the resulting frictional forces acting to grip the locking bar sufficiently so that the unlatching force illustrated by arrow 28 can be coupled thereto.

Frictional forces between coupling device 16 and locking bar 21 may be enhanced by the use of a friction enhancing coating on coupling device 16, the friction enhancing coating being most readily perceived in the drawings by reference to coupling device 16 in FIG. 1 wherein friction enhancing coating 36 is best depicted.

Although the foregoing specification has described the use of the invention as involving the application of the unlatching force 27 by either pulling on handle 17 or string-like member 34, other means may be employed to impress the unlatching force on the shaft or offset member, such as by tapping the shaft with a hammer.

The foregoing is a complete description of an exemplary embodiment of a car door opening tool which is constructed in accordance with the principles of this invention. It is likely that changes and modifications will occur to those skilled in this art which are within the inventive concepts disclosed and claimed herein.

What is claimed is:

1. A vehicle door opening tool for opening a locked vehicle door from outside the vehicle, comprising:

an elongate shaft for inserting into the interior of the door of a vehicle through a gap between the glass and weather strip of the door, the shaft having a handle end and a locking car engaging end and being at least substantial straight between said ends, the length of the shaft being greater than the distance between the gap at the vehicle door and a locking bar within the vehicle door for opening the door;

locking bar engaging means projecting from the locking bar engaging end of the shaft for engaging around the locking bar within the vehicle door, the locking bar engaging means comprising a projection from the shaft and a generally U-shaped, at the free end or the projection, said hook having at opening downwardly facing in a direction opposite to said handle end, the hook comprising means for partially encircling the locking bar and having opposed generally parallel portions for contacting opposed points of the locking bar to grip the locking bar on axial twisting of the elongate shaft;

handle means projecting from the handle end of the shaft comprising means for axial twisting or said shaft by an operator to rotate the locking bar engaging means into a positiong ripping the locking bar; and a string-like member secured to the hook, said string-like member comprising means for pulling by an operator and for transmitting pulling force of an operator into an unlatching force applied in a longitudinal direction of a locking bar engaged by the tool.

2. The tool as claimed in claim 1, wherein said hook is orientated to face in a direction generally parallel to the shaft.

3. The tool as claimed in claim 1, wherein the shaft projection and hook-like means are co-planar.

4. The tool as claimed in claim 3, wherein said hook-like means comprises a portion at the free end of said projection bent first in one direction towards the handle end of the shaft and then in the opposite direction to form a hook facing away from the handle end of the shaft.

5. The tool as claimed in claim 3, wherein the handle end of said shaft comprises a further projection substantially perpendicular to said shaft pointing in an opposite direction to the first mentioned projection at the locking bar engaging end of the shaft.

6. The tool as claimed in claim 5, wherein said handle end projection is bent to form a handle-like shape.

7. The tool as claimed in claim 5, wherein the handle and locking bar engaging ends of said shaft are identical and each comprise means for interchangeably acting as the handle and locking bar engaging parts of the tool.

8. The tool as claimed in claim 7, wherein said string-like member is releasably connected to said hook.

9. The tool as claimed in claim 5, wherein said shaft, handle means and locking bar engaging means are of unitary construction, said shaft comprising a substantially rigid wire-like member and said handle means and locking bar engaging means comprising bent end portions of said wire-like member.

10. The tool as claimed in claim 9, wherein said wire-like member is of circular cross section.

11. The tool as claimed in claim 9, wherein said wire-like member has a plastic coating covering at least said locking bar engaging means.

12. The tool as claimed in claim 1, wherein said hook-like means has a friction enhacing covering comprising means of increasing the gripping force between said hook-like means and a locking bar in engagement with said hook-like means.

13. The tool as claimed in claim 12, wherein said covering comprises a plastic coating.

14. The tool as claimed in claim 12, wherein said covering comprises a rubber coating.

15. A method of opening a locked vehicle door of the type having a locking bar within the door for movement in an unlocking direction to open the door, comprising the steps of:

inserting an elongate member having a handle at one end and a projection at the other end with a generally U-shaped down facing hook member at the free end of the projecting into the door by sliding it into a gap between the window glass and weatherstrip of the door with the locking bar engaging end entering the door first and the handle end projecting out of the gap;

manipulating the elongate member until the hook is engaged around the locking bar by pushing down at the handle end until the hook engages over the looking bar;

grippng the handle and axially twisting the elongate member via the handle until opposed portions of the hook contract the locking bar at two opposed points on the locking bar to grip the locking bar at those points; and applying a longitudinal force to the locking bar in an unlatching direction by pulling one end of a string secured at its opposite end to the hook in a direction generally parallel to the locking bar while simultaneously maintaining a twisting force on the elongate member so as to maintain gripping contact of the hook with the locking bar.

* * * * *

UNITED STATES PATENT AND TRADEMARK OFFICE

CERTIFICATE OF CORRECTION

PATENT NO. : 4,683,783

DATED : August 4, 1987

INVENTOR(S) : Victor V. Fanberg

It is certified that error appears in the above-identified patent and that said Letters Patent is hereby corrected as shown below:

Column 6, claim 1, line 13, "car" should be --bar--

Column 6, claim 1, line 34, "positiong ripping" should be --position gripping--

Column 8, claim 15, line 13, "contract" should be --contact--

Column 8, claim 15, line 14, "on" should be --of--

Signed and Sealed this

Twenty-second Day of March, 1988

*Attest:*

*Attesting Officer*

DONALD J. QUIGG

*Commissioner of Patents and Trademarks*